US008270648B2

(12) United States Patent
Murozaki

(10) Patent No.: US 8,270,648 B2
(45) Date of Patent: Sep. 18, 2012

(54) EARPIECE AND ELECTRO-ACOUSTIC TRANSDUCER

(75) Inventor: Katsunori Murozaki, Chiba (JP)

(73) Assignee: Sony Corporation, Tokyo (JP)

( * ) Notice: Subject to any disclaimer, the term of this patent is extended or adjusted under 35 U.S.C. 154(b) by 861 days.

(21) Appl. No.: 12/189,084

(22) Filed: Aug. 8, 2008

(65) Prior Publication Data

US 2009/0052711 A1 Feb. 26, 2009

(30) Foreign Application Priority Data

Aug. 24, 2007 (JP) ..... P2007-218997

(51) Int. Cl.
*H04R 25/00* (2006.01)

(52) U.S. Cl. ..... 381/328; 381/312; 381/322; 381/324; 381/329; 381/330; 381/380

(58) Field of Classification Search ..... 381/312, 381/322, 324, 328–330, 380
See application file for complete search history.

(56) References Cited

U.S. PATENT DOCUMENTS

| | | | | |
|---|---|---|---|---|
| 4,965,838 | A * | 10/1990 | Kamon et al. | 381/380 |
| 4,981,194 | A * | 1/1991 | Kamon et al. | 181/129 |
| 5,781,638 | A | 7/1998 | Hosaka et al. | |
| 5,988,313 | A * | 11/1999 | H.ang.kansson | 181/135 |
| 6,738,487 | B1 * | 5/2004 | Nageno et al. | 381/322 |

FOREIGN PATENT DOCUMENTS

| | | |
|---|---|---|
| JP | S58-076299 | 5/1983 |
| JP | H04-057991 | 5/1992 |
| JP | H07-218759 | 8/1995 |
| JP | 2000-341784 | 12/2000 |

OTHER PUBLICATIONS

Office Action dated Dec. 13, 2011 in corresponding Japanese Patent Application No. 2007-218997 (6 pages).
Office Action dated Jun. 16, 2011 in corresponding Chinese Patent Application No. 200810146309.6 (11 pages).

* cited by examiner

*Primary Examiner* — Andy Huynh
(74) *Attorney, Agent, or Firm* — Finnegan, Henderson, Farabow, Garrett & Dunner, L.L.P.

(57) ABSTRACT

An earpiece including a tubular core portion attached to an end of an electro-acoustic transducer and extending in an acoustic wave output direction, and an external auditory canal fitting portion disposed outside the core portion to cover an end surface of the core portion and having lower hardness than the core portion is provided. This maintains appropriate flexibility of the external auditory canal fitting portion covering the end surface of the core portion and forms the core portion with appropriate hardness. This eliminates sound quality degradation due to the core portion deformation, earpiece detachment and contact of the core portion with the external auditory canal. Consequently, this improves fitting properties with the external auditory canal and attachment properties with the electro-acoustic transducer. The earpiece which improves fitting properties with the external auditory canal and attachment properties with the electro-acoustic transducer, and the electro-acoustic transducer including the same are thereby provided.

6 Claims, 7 Drawing Sheets

EARPIECE AND ELECTRO-ACOUSTIC TRANSDUCER

CROSS REFERENCES TO RELATED APPLICATIONS

The present invention contains subject matter related to Japanese Patent Application JP 2007-218997 filed in the Japan Patent Office on Aug. 24, 2007, the entire contents of which being incorporated herein by reference.

BACKGROUND OF THE INVENTION

1. Field of the Invention

The present invention relates to an earpiece and an electro-acoustic transducer.

2. Description of the Related Art

An electro-acoustic transducer such as an earphone drives a diaphragm according to an audio signal which is supplied from an audio reproducer, thereby generating an acoustic wave in the audible frequency range which corresponds to the audio signal. The generated acoustic wave is output to the external auditory canal of a user through an earpiece which is attached to the electro-acoustic transducer and vibrates the eardrum, so that it is transmitted as audio information.

An inner-type earphone with an earpiece attached at its end, for example, which is called an earplug-type earphone, is commercialized. The earpiece includes a tubular core portion which is attached to the end of an electro-acoustic transducer and extends in the output direction of an acoustic wave, and an external auditory canal fitting portion which is disposed outside of the core portion and fitted into the external auditory canal.

FIG. 7A shows an example of an earpiece 50 in which a core portion 52 and an external auditory canal fitting portion 56 are molded in one piece. In such kind of the earpiece 50, the core portion 52 and the external auditory canal fitting portion 56 are made of a single elastic material such as elastomer. Because the adhesive properties between the elastic material which forms the core portion 52 and the external auditory canal fitting portion 56 are poor, the integral molding which does not require the adhesive bonding is used.

FIG. 7B shows an example of an earpiece 60 in which a core portion 62 and an external auditory canal fitting portion 66 are molded as separate pieces. In such kind of the earpiece 60, the core portion 62 is made of a material with a relatively high hardness such as chloroethene, and the external auditory canal fitting portion 66 is made of a material with a moderate flexibility such as a cushioning material. Because a certain degree of bonding properties (adhesive properties) are assured between the members, the core portion 62 and the external auditory canal fitting portion 66 are molded as separate pieces and then bonded together.

SUMMARY OF THE INVENTION

In the earpiece 50 shown in FIG. 7A, a moderately flexible material is used so as to assure fitting properties when the external auditory canal fitting portion 56 is fitted into the external auditory canal a (cf. FIG. 4). However, due to the use of the flexible material, the core portion 52 which outputs an acoustic wave to the external auditory canal a, particularly its end, is subject to deformation to block off the end of an earphone, which causes sound quality degradation. Further, an attachment portion of the earpiece 50 to be attached to the end of an earphone, particularly, is easily deformed, which causes detachment of the earpiece 50 from the end of the earphone.

On the other hand, in the earpiece 60 shown in FIG. 7B, the end of the core portion 62 extends to the near end of the external auditory canal fitting portion 66 in order to have an appropriate bonded area (adhesive area) between the core portion 62 and the external auditory canal fitting portion 66 and to maintain an appropriate shape of the end of the earpiece 60. Thus, when the external auditory canal fitting portion 66 is fitted into the external auditory canal a, the end of the core portion 62 comes into contact with the external auditory canal a, which decreases fitting properties.

It is desirable to provide an earpiece which improves the fitting properties with an external auditory canal and the attachment properties with an electro-acoustic transducer, and an electro-acoustic transducer including the same.

According to an embodiment of the present invention, there is provided an earpiece to be attached to an electro-acoustic transducer, for guiding an acoustic wave generated from the electro-acoustic transducer to an external auditory canal with the earpiece being fitted to the external auditory canal. The earpiece includes a tubular core portion to be attached to an end of the electro-acoustic transducer so as to extend in an output direction of the acoustic wave, and an external auditory canal fitting portion disposed outside of the core portion so as to cover an end surface of the core portion and formed to have a lower hardness than the core portion.

In this structure, the external auditory canal fitting portion which is disposed outside of the core portion so as to cover the end surface of the core portion is formed to have a lower hardness than the core portion which is attached to the end of the electro-acoustic transducer. It is thereby possible to maintain an appropriate flexibility of the external auditory canal fitting portion which covers the end surface of the core portion and form the core portion with an appropriate hardness. This eliminates issues such as sound quality degradation due to change in shape of the core portion, detachment of the earpiece, and contact of the core portion with the external auditory canal. Further, because the core portion is formed with an appropriate hardness, it is possible to reduce the diameter of the core portion by a decrease in the thickness of a member. Consequently, it is possible to improve the fitting properties with the external auditory canal and the attachment properties with the earphone.

In the above-described earpiece, the core portion and the external auditory canal fitting portion may be made of the same material with different hardness. In this structure, because the core portion and the external auditory canal fitting portion are made of the same material with different hardness, it is possible to facilitate material acquisition and thereby simplify the manufacturing process.

Further, in the above-described earpiece, an end of the core portion may be cone-shaped. In this structure, because the end of the core portion is cone-shaped, the deformability of a connecting portion of the external auditory canal fitting portion which is connected to the end of the core portion increases, and it is thereby possible to further improve the fitting properties with the external auditory canal. Further, a connecting surface between the core portion and the external auditory canal fitting portion is enlarged, which improves the connection properties between members.

Furthermore, in the above-described earpiece, the external auditory canal fitting portion may be formed continuously from the end surface of the core portion to an outside of the core portion and create a space around the core portion. In this structure, because the external auditory canal fitting portion is formed continuously from the end surface of the core portion to an outside of the core portion and creates a space around the core portion, the external auditory canal fitting portion changes its shape according to the shape of the auricle, a change in the fitted position and so on, and it is thereby possible to further improve the fitting properties with the external auditory canal.

In the above-described earpiece, the core portion may be made of an elastic material. In this structure, because the core portion is made of an elastic material, the core portion changes its shape together with the external auditory canal fitting portion according to the shape of the auricle, a change in the fitted position and so on, and it is thereby possible to further improve the fitting properties with the external auditory canal.

According to another embodiment of the present invention, there is provided an electro-acoustic transducer which includes the earpiece according to the embodiment described above. In this structure, it is possible to provide the electro-acoustic transducer which includes the earpiece in which the fitting properties with the external auditory canal and the attachment properties with the electro-acoustic transducer are improved.

According to the embodiments of the present invention described above, it is possible to provide an earpiece which improves the fitting properties with an external auditory canal and the attachment properties with an electro-acoustic transducer, and an electro-acoustic transducer including the same.

DETAILED DESCRIPTION OF THE PREFERRED EMBODIMENTS

Figure 1D:
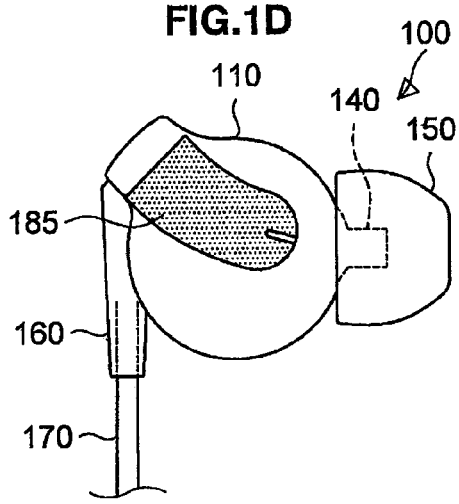
FIG. 1D is an external view of an earphone to which an earpiece according to an embodiment of the present invention is attached.

Hereinafter, preferred embodiments of the present invention will be described in detail with reference to the appended drawings. Note that, in the specification and the appended drawings, structural elements that have substantially the same function and structure are denoted with the same reference numerals, and repeated explanation of these structural elements is omitted.

(External Structure of Earphone)

Figure 1A:
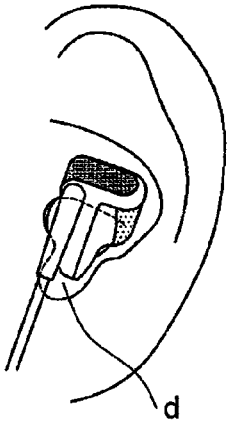
FIG. 1A is an external view of an earphone to which an earpiece according to an embodiment of the present invention is attached.
Figure 1B:
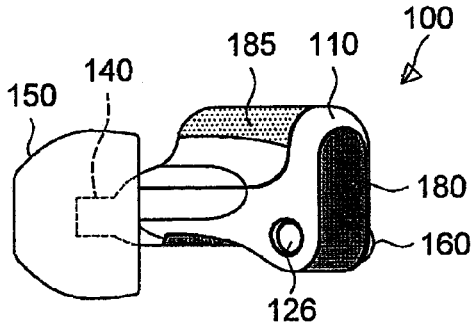
FIG. 1B is an external view of an earphone to which an earpiece according to an embodiment of the present invention is attached.
Figure 1E:
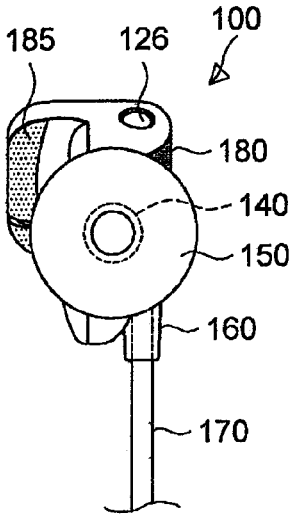
FIG. 1E is an external view of an earphone to which an earpiece according to an embodiment of the present invention is attached.
Figure 1C:
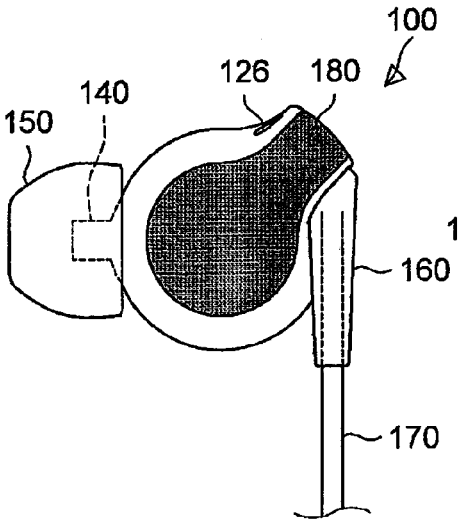
FIG. 1C is an external view of an earphone to which an earpiece according to an embodiment of the present invention is attached.
Figure 1F:
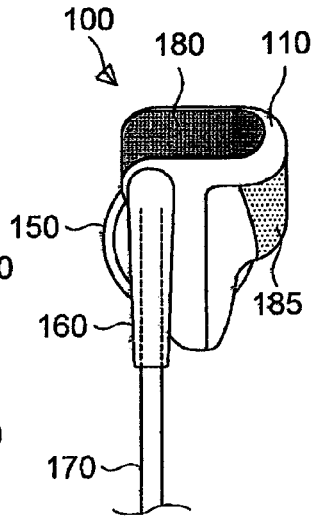
FIG. 1F is an external view of an earphone to which an earpiece according to an embodiment of the present invention is attached.

The external structure of an earphone 100 to which an earpiece 150 according to an embodiment of the present invention is attached is described hereinbelow. FIG. 1A to FIG. 1F show the external views of the earphone 100 to be attached to the left ear of a user. FIG. 1A shows the fitted state of the earphone 100. FIG. 1B is a perspective view of the earphone 100 when viewed from the slanting rear. FIG. 1C is an anterior view of the earphone 100 in the fitted state when viewed from substantially the front side of a user, and FIG. 1D is a posterior view when viewed from substantially the rear side of a user. FIG. 1E is a front view of the earphone 100 when viewed from the front, and FIG. 1F is a rear view when viewed from the rear (which corresponds to the state when viewed from substantially the side of a user).

Referring to FIG. 1A to FIG. 1F, the earphone 100 includes a substantially disciform housing 110, a substantially cylindrical sound guide tube 140 which protrudes from the housing 110, and an earpiece 150 which is attached to the end of the sound guide tube 140. The earphone 100 further includes a bushing 160 which protrudes from the rear side, and a cord 170 which is held by the bushing 160. The housing 110 is partly covered with an anterior cap 180 which bends like a substantially L shape and a substantially semi-cylindrical posterior cap 185.

The housing 110 is made of a lightweight solid material such as magnesium for a smaller and thinner case. The housing 110 contains a driver unit 190 which includes a diaphragm 198 and creates a space that surrounds the anterior surface of the diaphragm 198. The driver unit 190 drives the diaphragm 198 according to an audio signal which is supplied through the cord 170, thereby generating aerial vibration in the anterior space of the diaphragm 198. The upper surface of the housing 110 has an air hole 126 which allows the anterior space of the diaphragm 198 to communicate with the outside of the housing 110.

The sound guide tube 140 is integrally molded with the housing 110 so as to protrude to the front of the earphone 100, and it is inserted into the external auditory canal a with the earpiece 150 interposed therebetween. The sound guide tube 140 outputs the aerial vibration which is generated by the driver unit 190 to the external auditory canal a as an acoustic wave in the audible frequency range which corresponds to the audio signal.

The earpiece 150 is made of an elastic material such as silicon rubber or elastomer, for example. The earpiece 150 changes its shape according to the shape of the external auditory canal a of a user, so that the housing 110 is held by the external auditory canal a in close contact with the external auditory canal a.

The bushing 160 is made of an elastic material such as elastomer, for example. The bushing 160 fixes the pullout position of the cord 170 which is connected to the driver unit 190 with respect to the housing 110. The bushing 160 extends from the rear side of the housing 110 to avoid contact with the auricle, and when the earphone 100 is fitted in the ear, the bushing 160 points downward substantially vertically so that a user can pinch it by fingers.

The anterior cap 180 is made of stainless steel or the like, and the posterior cap 185 is made of plastic or the like, for example. The anterior cap 180 and the posterior cap 185 protect the housing 110, the cord 170, air holes 128 and 136 which are described later, and so on.

(Internal Structure of Earphone)

Figure 2:
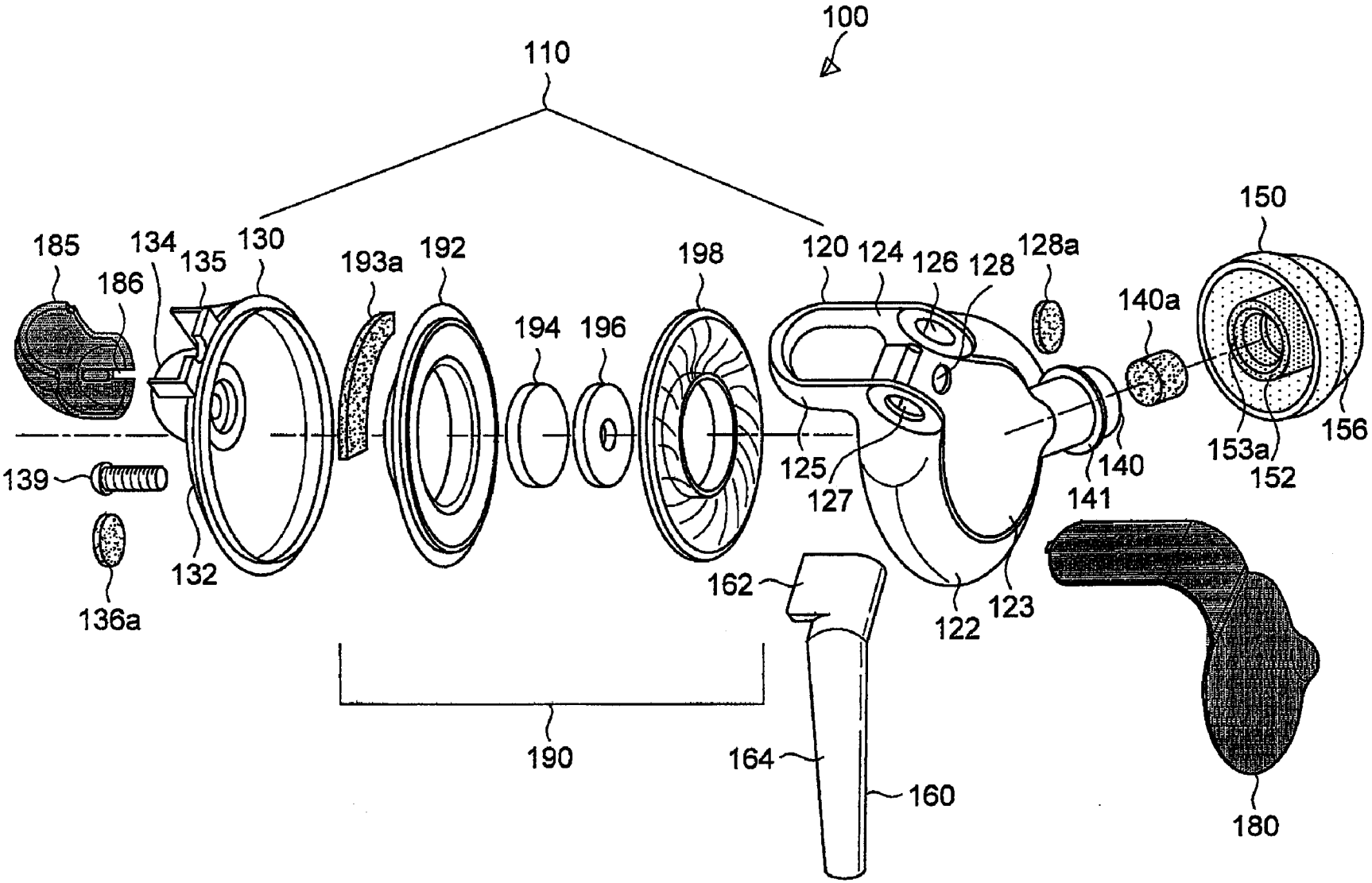
FIG. 2 is an exploded perspective view of the earphone shown in FIG. 1A to FIG. 1F.

The internal structure of the earphone 100 to which the earpiece 150 according to the embodiment of the present invention is attached is described hereinafter. FIG. 2 shows the state where the earphone 100 is taken apart, and FIG. 3 shows the earphone 100 along the section which is perpendicular to the fitted surface P of the diaphragm 198 and includes the central axis C1 of the sound guide tube 140.

Figure 3:
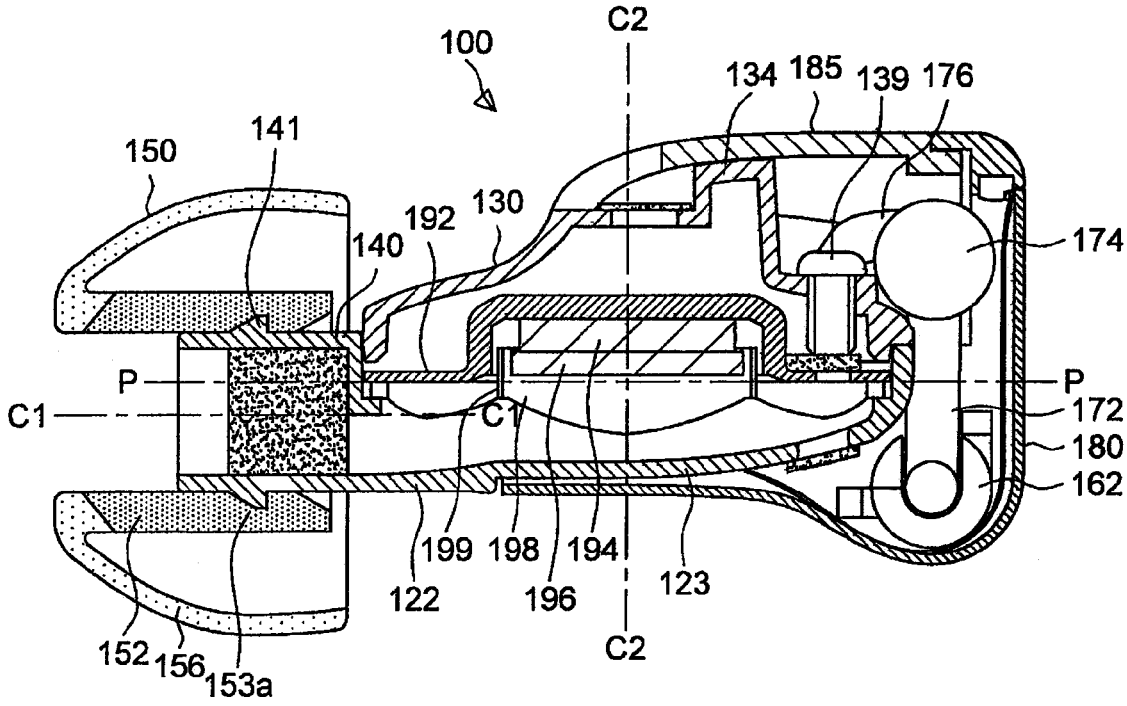
FIG. 3 is a sectional view of the earphone shown in FIG. 1A to FIG. 1F

Referring to FIGS. 2 and 3, the housing 110 is composed of an anterior housing 120 and a posterior housing 130, each of which has a substantially bowl shape. The housing 110 is formed by bonding the anterior housing 120 and the posterior housing 130 by ultrasonic welding, for example, with the driver unit 190 placed inside.

The anterior housing 120 includes a substantially bowl-shaped anterior portion 122, the sound guide tube 140 which protrudes from a part of the side wall that forms the anterior portion 122, and a bending portion 124 which bends from another part of the side wall. When the earphone 100 is fitted in the ear, the anterior portion 122 is disposed on substantially the front side of a user, the sound guide tube 140 is disposed substantially concentrically with the external auditory canal a of a user, and the bending portion 124 is disposed on substantially the side of a user.

The anterior portion 122 has a depressed portion 123 in the part corresponding to a bowl bottom and further has an air hole 128 in the vicinity of the boundary with the bending portion 124. The sound guide tube 140 has a ring-shaped engaging projecting portion 141, and an air-flow resistance 140*a* is inserted to the sound guide tube 140. The bending portion 124 has a side wall 125 in a flat U-shape when viewed from the side of a user, which protrudes from a side wall that forms the anterior portion 122. The bending portion 124 has a space which is surrounded by the side wall 125 in order to store the bushing 160, the cord 170 and so on. The side wall 125 has an air hole 126 and a bushing attachment hole 127 in the part near the boundary with the anterior portion 122. The air hole 128 is covered with an air-flow resistance 128*a*.

The posterior housing 130 includes a substantially bowl-shaped posterior portion 132 and a curving portion 134 with a side wall 135 in a flat curve shape vertically formed in a part of the area corresponding to a bowl bottom. The curving portion 134 has a space which is surrounded by the side wall 135 in order to store the cord 170. When the earphone 100 is fitted in the ear, the posterior portion 132 is disposed on substantially the rear side of a user, and the curving portion 134 is disposed in the upper space of the antitragus b without contact with the auricle of a user. The posterior portion 132 which is positioned below the curving portion 134 is disposed in the incisura intertragica d (cf. FIG. 1A) together with the anterior portion 122 which is positioned below the bending portion 124.

The posterior portion 132 has the shape substantially corresponding to the anterior portion 122. The space which is created by the side wall 135 of the curving portion 134 has substantially the same width as the space which is created by the side wall 125 of the bending portion 124, and the two spaces are connected to create one space.

The earpiece 150 includes a core portion 152 which is attached to the sound guide tube 140, an external auditory canal fitting portion 156 which is formed continuously from the end of the core portion 152 to the outside so as to create a space around the core portion 152, and an engaging depressed portion 153*a* which is formed in the core portion 152 so as to engage with the engaging projecting portion 141 of the sound guide tube 140. The earpiece 150 is inserted into the external auditory canal a substantially concentrically with the external auditory canal a and fitted to the external auditory canal a with the external auditory canal fitting portion 156 in contact therewith.

The bushing 160 includes an attachment portion 162 and a cord fixing portion 164 which extends from the attachment portion 162. The attachment portion 162 is attached to the bushing attachment hole 127 in the bending portion 124 of the anterior housing 120 so that it is slightly rotatable. The cord fixing portion 164 fixes the pullout position of the cord 170 which is connected to the driver unit 190 with respect to the housing 110.

The anterior cap 180 covers the space which is created by the depressed portion 123 of the anterior housing 120 and the side wall 125 of the bending portion 124. The posterior cap 185 covers the space which is created by the side wall 135 of the curving portion 134 of the posterior housing 130 in connection with the bending portion 124 of the anterior housing 120, and it has an air hole 186 at its end. Further, the anterior cap 180 and the posterior cap 185 are formed to cover the air holes 128 and 136 of the anterior housing 120 and the posterior housing 130, respectively.

The cord 170 is disposed on the rear side of the anterior housing 120 through the attachment portion 162 of the bushing 160 which is disposed in the space that is created by the side wall 125 of the bending portion 124 of the anterior housing 120, pulled into the space that is created by the side wall 135 of the curving portion 134 of the posterior housing 130 (cord 172), and connected to a cord 176 on the driver unit 190 side via a knot 174 as shown in FIG. 3. Further, the anterior cap 180 and the posterior cap 185 are fitted onto the anterior housing 120 and the posterior housing 130, respectively, thereby protecting the bushing 160 and the cord 170 which are disposed on the rear side of the housing 110.

The driver unit 190 is composed a frame 192, a magnet 194, a pole piece 196, and the diaphragm 198. In the driver unit 190, the diaphragm 198 which includes a voice coil 199 is disposed in a magnetic circuit that is composed of the magnet 194, and the diaphragm 198 is driven according to an audio signal which is supplied to the voice coil 199 through the cord 170. The driver unit 190 is integrated with the housing 110 in the state where it is placed between the anterior housing 120 and the posterior housing 130 with the frame 192 interposed therebetween, thereby suppressing unnecessary vibration and improving the sound quality in the low frequency range. In the state where the driver unit 190 is contained in the housing 110, there is a space on each of the anterior side and the posterior side of the driver unit 190. The frame 192 has two air holes, and one air hole is fixed with an air-flow resistance 193*a* by using an air permeability adjusting member 139, and another air hole 136 is covered with an air-flow resistance 136*a*.

(Earpiece)

Figure 4:
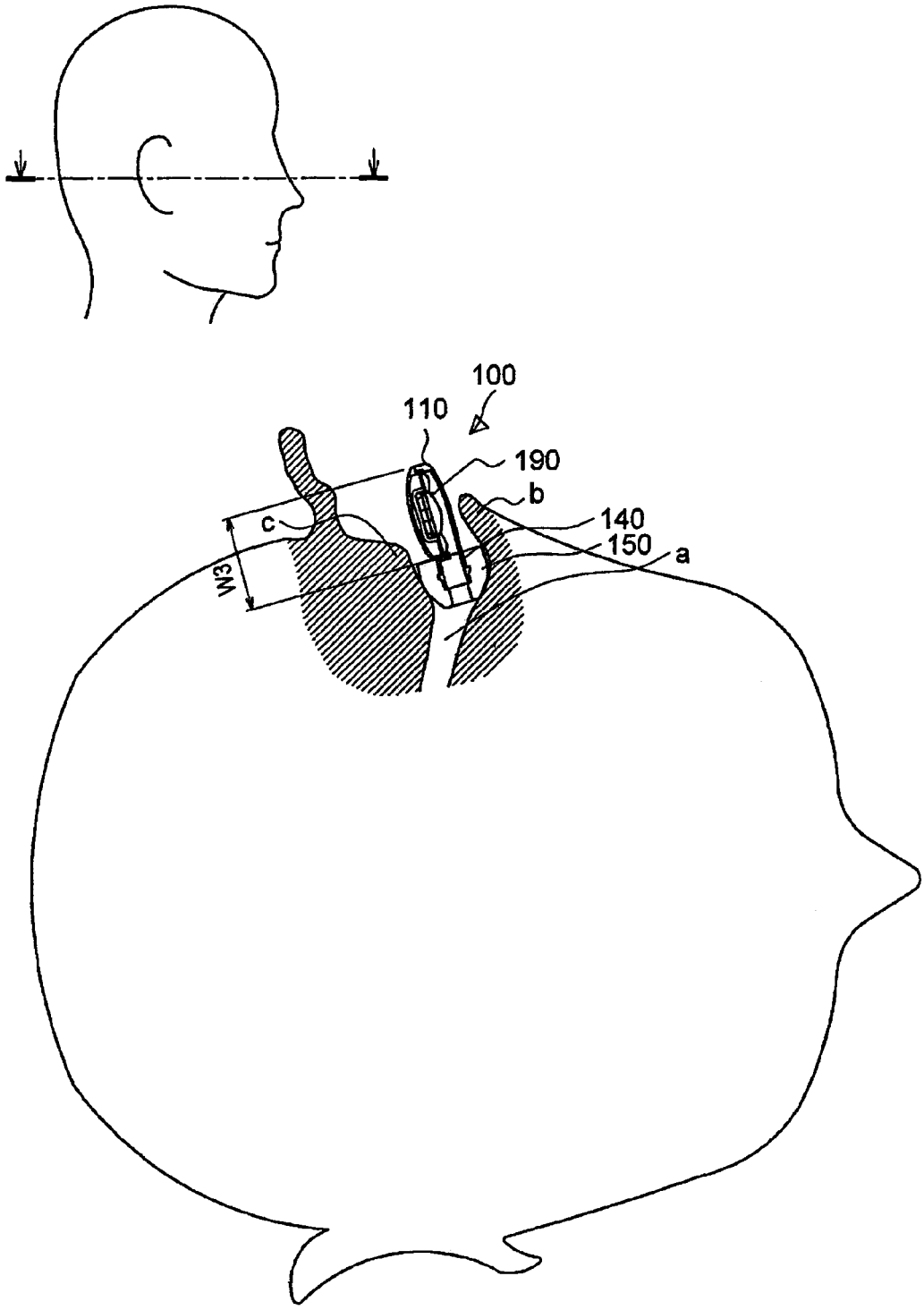
FIG. 4 is an explanatory view showing the fitted state of the earphone shown in FIG. 1A to FIG. 1F.

FIG. 4 is an explanatory view showing the fitted state of the earphone 100 which is described above. Referring to FIG. 4, the earphone 100 is fitted to the external auditory canal a with the earpiece 150 that is attached to the sound guide tube 140 in contact therewith in the state where the housing 110 is disposed in the cavum conchae d (cf. FIG. 1A) and the sound guide tube 140 is inserted into the external auditory canal a between the tragus b and the antitragus c. The earpiece 150 changes its shape according to the shape of the external auditory canal a so as to improve the contact with the external auditory canal a, and the end of the earpiece 150 comes into contact with the external auditory canal a in some cases.

First Embodiment

Figure 5A:
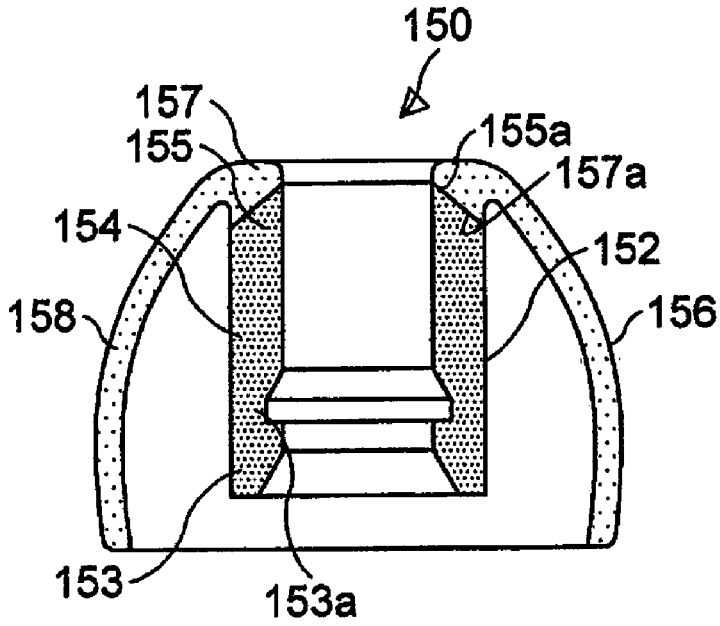
FIG. 5A is a sectional view showing an earpiece according to the first embodiment of the present invention.
Figure 5B:
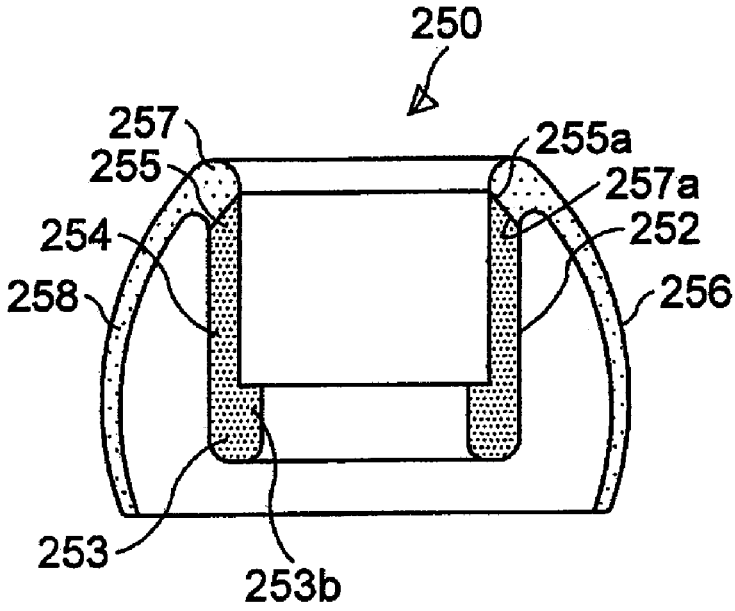
FIG. 5B is a sectional view showing another earpiece according to the first embodiment of the present invention.

FIG. 5A and FIG. 5B are sectional views showing examples of an earpiece according to a first embodiment of the present invention. In the earpiece 150, 250 according to the embodiment, the core portion 152, 252 and the external auditory canal fitting portion 156, 256 are molded in one piece. The earpiece 150 shown in FIG. 5A is composed of the tubular core portion 152 and the substantially cap-shaped external auditory canal fitting portion 156.

The core portion 152 is attached to the sound guide tube 140 which protrudes from the earphone 100 and extends in the output direction of an acoustic wave. The core portion 152 is composed of an attachment portion 153 which is attached to the sound guide tube 140, an output portion 154 which outputs an acoustic wave that is guided through the sound guide tube 140, and an end portion 155 which is located at the end of the output portion 154.

The attachment portion 153 has the engaging depressed portion 153*a* so as to engage with the engaging projecting portion 141 which is formed on the periphery of the sound guide tube 140. The end portion 155 has a connecting surface 155*a* (end surface) which corresponds to a connecting surface 157*a* of a connecting portion 157 of the external auditory canal fitting portion 156, and the core portion 152 and the external auditory canal fitting portion 156 are molded in one piece with the connecting surfaces 155*a* and 157*a* as interfaces. The end portion 155 also has a substantially cone-shaped end surface 155*a*. The connecting surface between the core portion 152 and the external auditory canal fitting portion 156 is thereby enlarged to improve the connection properties between the members.

The external auditory canal fitting portion 156 is formed continuously from the end surface 155*a* of the core portion 152 to the outside and creates a space around the core portion 152. The external auditory canal fitting portion 156 thereby changes its shape according to the shape of the auricle, a change in the fitted position and so on, which further improves the fitting properties with the external auditory canal a. The external auditory canal fitting portion 156 is composed of the connecting portion 157 which has the connecting surface 157*a* to be connected to the core portion 152 and an expanding portion 158 which is formed continuously from the connecting portion 157 and folded to the outside of the core portion 152, with the diameter expanding gradually with respect to the central axis of the earpiece 150.

The connecting portion 157 has the cone-shaped connecting surface 157*a* which corresponds to the connecting surface 155*a* of the core portion 152, and the core portion 152 and the external auditory canal fitting portion 156 are molded in one piece with the connecting surfaces 155*a* and 157*a* as interfaces so as to cover the connecting surface 155*a* (end surface) of the core portion 152. The deformability of the connecting portion 157 of the external auditory canal fitting portion 156 thereby increases, which further improves the fitting properties with the external auditory canal a.

In the earpiece 150 shown in FIG. 5A, the core portion 152 and the external auditory canal fitting portion 156 are made of silicon rubber. The core portion 152 and the external auditory canal fitting portion 156 may be made of an elastic material such as elastomer or nitrile rubber (NBR), for example, besides silicon rubber. The core portion 152 is made of silicon rubber with a hardness of 50 to 90, and the external auditory canal fitting portion 156 is made of silicon rubber with a hardness of 20 to 50, which is lower than that of the core portion 152, for example.

The earpiece 150 shown in FIG. 5A may be densely molded in one piece using a two-color injection molding machine without bonding members which are made of materials with different hardness. The two-color injection molding first prepares a forming die which corresponds to the shape of the whole earpiece 150. The earpiece 150 is molded in one piece in the state before the external auditory canal fitting portion 156 is folded outward. Then, a material which forms either one of the core portion 152 or the external auditory canal fitting portion 156 is injected into the forming die, and, after the material hardens to a predetermined degree, a material which forms the other one of the core portion 152 or the external auditory canal fitting portion 156 is injected into the forming die. After the material hardens to a predetermined degree, the earpiece 150 as a molded item is obtained. The earpiece 150 in which the core portion 152 and the external auditory canal fitting portion 156 are formed in one piece with the connecting surfaces 155*a* and 157*a* as interfaces is thereby molded.

Because the core portion 152 is made of an elastic material, the core portion 152 changes its shape together with the external auditory canal fitting portion 156 according to the shape of the auricle, a change in the fitted position and so on, thereby further improving the fitting properties with the external auditory canal a.

An earpiece shown in FIG. 5B is composed of a tubular core portion 252 and a substantially cap-shaped external auditory canal fitting portion 256. Although the earpiece 250 shown in FIG. 5B has substantially the same structure as the earpiece 150 shown in FIG. 5A, an attachment portion 253 of the core portion 252 has an engaging projecting portion 253*a* so as to engage with an engaging depressed portion on the periphery of a sound guide tube.

As described above, in the earpiece 150, 250 according to this embodiment, the external auditory canal fitting portion 156, 256 which is disposed outside of the core portion 152, 252 so as to cover the end surface 155*a*, 255*a* of the core portion 152, 252 is formed to have a lower hardness than the core portion 152, 252 which is attached to the end of the earphone 100.

It is thereby possible to maintain an appropriate flexibility of the external auditory canal fitting portion 156, 256 which covers the end surface 155*a*, 255*a* of the core portion 152, 252 and form the core portion 152, 252 with an appropriate hardness. This eliminates issues such as sound quality degradation due to change in shape of the core portion 152, 252, detachment of the earpiece 150, 250, and contact of the core portion 152, 252 with the external auditory canal a. Further, because the core portion 152, 252 is formed with an appropriate hardness, it is possible to reduce the diameter of the core portion 152, 252 by a decrease in the thickness of a member. This allows the whole shape of the earpiece 150 to be formed into a shell shape as shown in FIG. 5A, which further improves the fitting properties with the external auditory canal a. Consequently, it is possible to improve the fitting properties with the external auditory canal a and the attachment properties with the earphone 100.

Second Embodiment

Figure 6A:
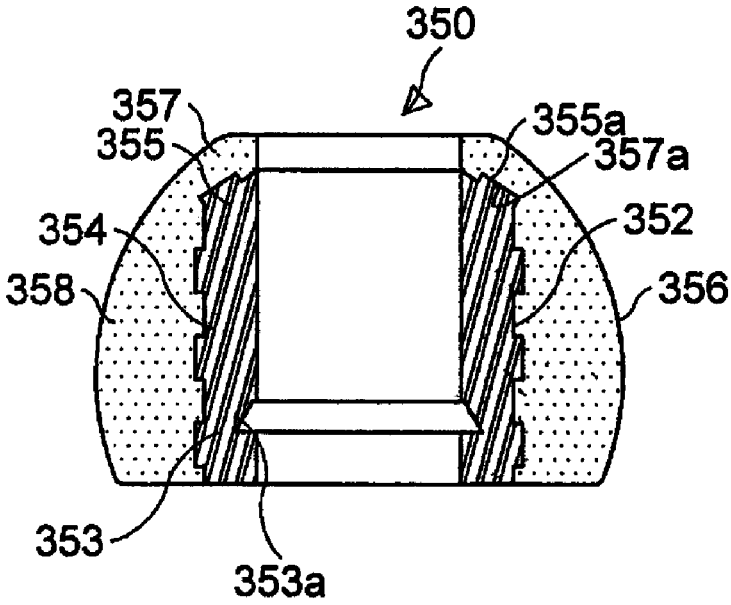
FIG. 6A is a sectional view showing an earpiece according to the second embodiment of the present invention.
Figure 6B:
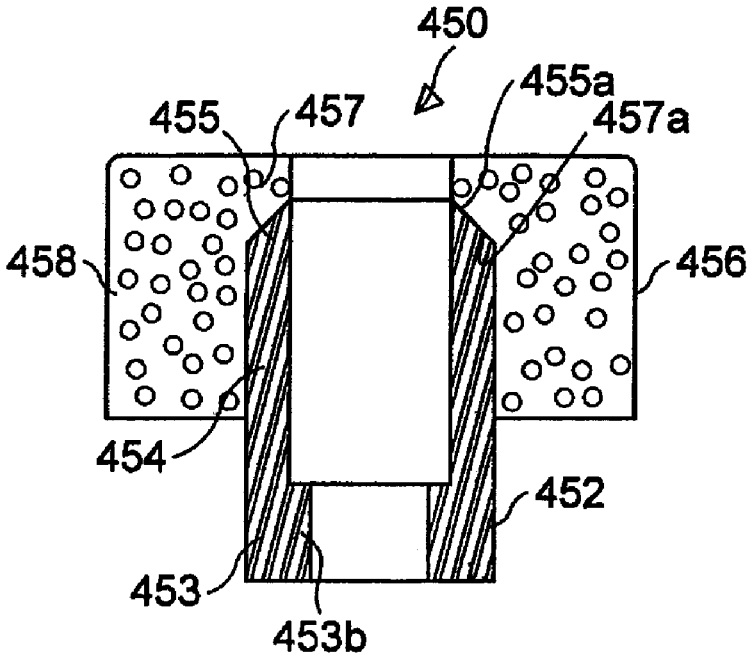
FIG. 6B is a sectional view showing another earpiece according to the second embodiment of the present invention.
Figure 7A:
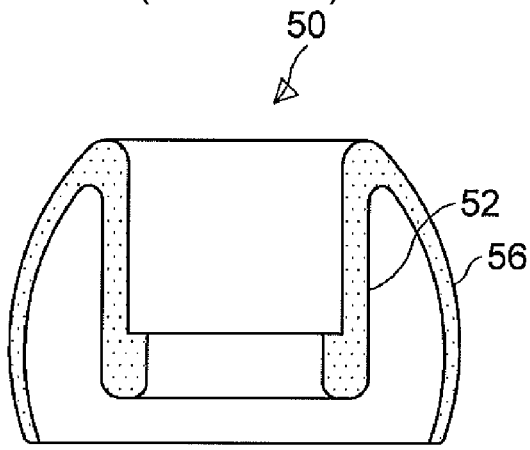
FIG.7A (Prior Art)
FIG. 7A is a sectional view showing an earpiece according to a related art.
Figure 7B:
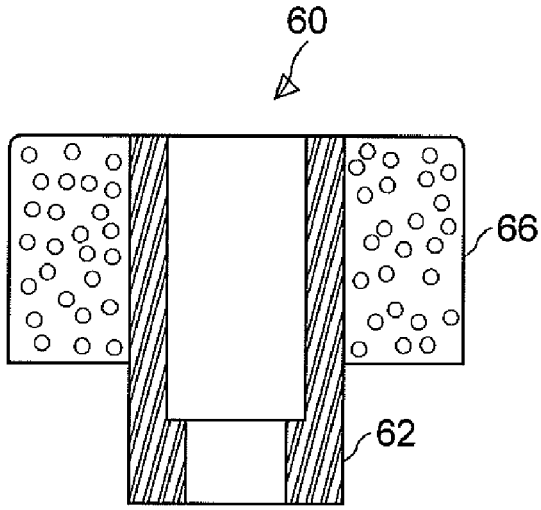
FIG.7B (Prior Art)
FIG. 7B is a sectional view showing another earpiece according to a related art.

FIG. 6A and FIG. 6B are sectional views showing examples of an earpiece according to a second embodiment of the present invention. In the earpiece of this embodiment, a core portion 352, 452 and an external auditory canal fitting portion 356, 456 are molded as separate pieces and bonded together. The description which is the same as the description about the earpiece according to the first embodiment is not given hereinbelow.

Although the earpiece 350, 450 is composed of a tubular core portion 352, 452 and an external auditory canal fitting portion 356, 456 just like the earpiece 150, 250, the external auditory canal fitting portion 356, 456 does not create a cap-shaped space around the core portion 352, 452.

In an earpiece 350 shown in FIG. 6A, an external auditory canal fitting portion 356 is formed so as to cover an attachment portion 353 and an output portion 354 of a core portion 352 in addition to an end surface 355*a* of the core portion 352. Further, the bonded surface between the external auditory canal fitting portion 356 and the core portion 352 (the outer surface of the attachment portion 353 and the output portion 354 and the end surface 355*a*, and the inner surface of an expanding portion 358 and a connecting surface 357*a*) has projections and depressions. The core portion 352 and the external auditory canal fitting portion 356 are bonded with each bonded surface (connecting surface) as interfaces. The core portion 352 and the external auditory canal fitting portion 356 may be bonded by the concurrent use of adhesive agent or only by the use of adhesive agent as long as bonding properties are assured.

In the earpiece 350 shown in FIG. 6A, the core portion 352 is made of chloroethene, and the external auditory canal fitting portion 356 is made of silicon rubber. The external auditory canal fitting portion 356 is made of a material with a lower hardness than that of the core portion 352. The core portion 352 may be made of polyethylene, ABS resin, plastic or the like rather than chloroethene, or it may be made of an elastic material or the like if bonding properties with the external auditory canal fitting portion 356 are assured. Because the earpiece 350 shown in FIG. 6A is made of materials which ensure a certain degree of adhesive properties between members, the bonding by adhesive bonding is feasible. Since the projections and depressions are formed on the bonded surfaces between the external auditory canal fitting portion 356 and the core portion 352, the bonded surfaces of the core portion 352 and the external auditory canal fitting portion 356 engage with each other, thereby improving the bonding characteristics between members.

In an earpiece 450 shown in FIG. 6B, an external auditory canal fitting portion 456 is formed so as to cover an output portion 454 of a core portion 452 in addition to an end surface 455*a* of a core portion 452. The core portion 452 and the external auditory canal fitting portion 456 are bonded by adhesive bonding with each bonded surface (the outer surface of the output portion 454 and an end surface 455*a*, and the inner surface of an expanding portion 458 and a connecting surface 457*a*) as interfaces. The core portion 452 and the external auditory canal fitting portion 456 may be bonded by the concurrent use of the projections and depressions or only by the projections and depressions as long as bonding properties are assured, just like the earpiece 350 shown in FIG. 6A.

In the earpiece 450 shown in FIG. 6B, the core portion 452 is made of chloroethene, and the external auditory canal fitting portion 456 is made of a cushioning material such as urethane, for example, so that the external auditory canal fitting portion 456 is made of a material with a lower hardness than that of the core portion 452. The core portion 452 may be made of polyethylene, ABS resin, plastic or the like rather than chloroethene. Because the earpiece 450 shown in FIG. 6B is also made of materials which ensure a certain degree of adhesive properties between members, the bonding by adhesive bonding is feasible.

As described above, in the earpiece 350, 450 according to this embodiment as well, the external auditory canal fitting portion 356, 456 which is disposed outside of the core portion 352, 452 so as to cover the end surface 355*a*, 455*a* of the core portion 352, 452 is formed to have a lower hardness than the core portion 352, 452 which is attached to the end of the earphone 100 as in the first embodiment. It is thereby possible to improve the fitting properties with the external auditory canal a and the attachment properties with the earphone 100.

Although the preferred embodiments of the present invention are described in the foregoing with reference to the drawings, the present invention is not limited thereto. It should be understood by those skilled in the art that various modifications, combinations, sub-combinations and alterations may occur depending on design requirements and other factors insofar as they are within the scope of the appended claims or the equivalents thereof.

For example, the case where the earpiece 150, 250, 350, 450 according to the embodiment of the present invention is attached to the earphone in which the sound guide tube 140 projects from an area that is different from the area on the housing 110, which corresponds to a plane of projection where the diaphragm 198 is projected onto the anterior side of the diaphragm 198, is described in the foregoing. However, the earpiece according to the present invention may be attached to another electro-acoustic transducer which includes a different shape of earphone and a hearing aid, for example.

Further, the material of each member which constitutes the earpiece 150, 250, 350, 450 is described by way of illustration in the above embodiments. However, the earpiece according to the present invention may be composed of members which are made of a material different from the material described above.

What is claimed is:

1. An earpiece configured to be attached to an electro-acoustic transducer, for guiding an acoustic wave generated from the electro-acoustic transducer to an external auditory canal with the earpiece being fitted to the external auditory canal, comprising:

a tubular core portion configured to be attached to an end of the electro-acoustic transducer so as to extend in an output direction of the acoustic wave; and an external auditory canal fitting portion disposed outside of the core portion so as to cover an end surface of the core portion and formed to have a lower hardness than the core portion, the external auditory canal fitting portion configured to be molded with the core portion and connected together by use of a cone-shaped connection surface which divides the lower hardness of the external auditory canal fitting portion from the core portion having a higher hardness.

2. The earpiece according to claim 1, wherein the core portion and the external auditory canal fitting portion are made of a common material but have different hardness.

3. The earpiece according to claim 1, wherein an end of the core portion is cone shaped.

4. The earpiece according to claim 1, wherein the external auditory canal fitting portion is formed continuously from the end surface of the core portion to an outside of the core portion and creates a space around the core portion.

5. The earpiece according to claim 1, wherein the core portion is made of an elastic material.

6. An electro-acoustic transducer comprising the earpiece according to claim 1.

* * * * *